US009896639B2

(12) United States Patent
Lancon et al.

(10) Patent No.: US 9,896,639 B2
(45) Date of Patent: Feb. 20, 2018

(54) LUBRICANT FOR MARINE ENGINE

(71) Applicant: TOTAL MARKETING SERVICES, Puteaux (FR)

(72) Inventors: Denis Lancon, Chassieu (FR); Valérie Doyen, Four (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 14/888,477

(22) PCT Filed: May 6, 2014

(86) PCT No.: PCT/EP2014/059232

§ 371 (c)(1),
(2) Date: Nov. 2, 2015

(87) PCT Pub. No.: WO2014/180843

PCT Pub. Date: Nov. 13, 2014

(65) Prior Publication Data

US 2016/0177216 A1 Jun. 23, 2016

(30) Foreign Application Priority Data

May 7, 2013 (FR) ..... 13 54182

(51) Int. Cl.
*C10M 169/04* (2006.01)
*C10M 163/00* (2006.01)
(Continued)

(52) U.S. Cl.
CPC ..... *C10M 169/04* (2013.01); *C10M 101/02* (2013.01); *C10M 129/06* (2013.01);
(Continued)

(58) Field of Classification Search
CPC ..... C10M 169/04; C10M 135/10; C10M 129/10; C10M 129/06; C10M 101/02; C10M 163/00; C10M 133/06; C10M 2207/262; C10M 2215/28; C10M 2219/046; C10M 2207/26; C10M 2215/04; C10M 2207/028; C10M 2207/021; C10M 2203/1085; C10M 2203/1006; C10N 2230/10; C10N 2210/01; C10N 2210/02; C10N 2230/02; C10N 2230/04; C10N 2230/08; C10N 2230/12; C10N 2230/52; C10N 2240/102; C10N 2270/02; C10N 2220/022
See application file for complete search history.

(56) References Cited

U.S. PATENT DOCUMENTS 5,900,392 A 5/1999 Bernhard
6,004,910 A 12/1999 Bloch et al.
(Continued)

OTHER PUBLICATIONS

International Maritime Organization, "Prevention of Air Pollution From Ships," Marine Environmental Protection Committee (2005), 12 pages.

*Primary Examiner* — Taiwo Oladapo
(74) *Attorney, Agent, or Firm* — Harness, Dickey & Pierce, PLC

(57) ABSTRACT

The present disclosure relates to a lubricant for marine engines including at least one base oil, at least one overbased detergent, at least one neutral detergent and at least one fatty amine.

18 Claims, 2 Drawing Sheets

(51) Int. Cl.

| | |
|---|---|
| ***C10M 133/06*** | (2006.01) |
| ***C10M 101/02*** | (2006.01) |
| ***C10M 129/06*** | (2006.01) |
| ***C10M 129/10*** | (2006.01) |
| ***C10M 135/10*** | (2006.01) |

(52) U.S. Cl.

CPC ..... *C10M 129/10* (2013.01); *C10M 133/06* (2013.01); *C10M 135/10* (2013.01); *C10M 163/00* (2013.01); *C10M 2203/1006* (2013.01); *C10M 2203/1085* (2013.01); *C10M 2207/021* (2013.01); *C10M 2207/028* (2013.01); *C10M 2207/26* (2013.01); *C10M 2207/262* (2013.01); *C10M 2215/04* (2013.01); *C10M 2215/28* (2013.01); *C10M 2219/046* (2013.01); *C10N 2210/01* (2013.01); *C10N 2210/02* (2013.01); *C10N 2220/022* (2013.01); *C10N 2230/02* (2013.01); *C10N 2230/04* (2013.01); *C10N 2230/08* (2013.01); *C10N 2230/10* (2013.01); *C10N 2230/12* (2013.01); *C10N 2230/52* (2013.01); *C10N 2240/102* (2013.01); *C10N 2270/02* (2013.01)

(56) References Cited

U.S. PATENT DOCUMENTS

| | | | | |
|---|---|---|---|---|
| 6,242,394 | B1 | 6/2001 | Chamberlin, III | |
| 7,071,150 | B2 | 7/2006 | Genuyt et al. | |
| 8,334,245 | B2 | 12/2012 | Lancon et al. | |
| 8,846,583 | B2 | 9/2014 | Espagne et al. | |
| 8,980,805 | B2 | 3/2015 | Doyen et al. | |
| 9,102,767 | B2 | 8/2015 | Dolmazon et al. | |
| 9,120,076 | B2 | 9/2015 | Matray et al. | |
| 2008/0287329 | A1 | 11/2008 | Lancon et al. | |
| 2010/0167969 | A1 | 7/2010 | Doyen et al. | |
| 2011/0059877 | A1 | 3/2011 | Obiols et al. | |
| 2011/0077177 | A1 | 3/2011 | Doyen | |
| 2011/0092403 | A1* | 4/2011 | Lancon ..... | C10M 163/00 508/391 |
| 2012/0077721 | A1 | 3/2012 | Dolmazon et al. | |
| 2012/0129742 | A1 | 5/2012 | Matray et al. | |
| 2012/0283151 | A1 | 11/2012 | Espagne et al. | |
| 2013/0244917 | A1 | 9/2013 | Obrecht et al. | |
| 2014/0041610 | A1 | 2/2014 | Lancon et al. | |
| 2014/0235516 | A1 | 8/2014 | Lancon | |

* cited by examiner

LUBRICANT FOR MARINE ENGINE

CROSS-REFERENCE TO RELATED APPLICATIONS

This application is a National Phase Entry of International Application Serial No. PCT/EP2014/059232 filed on May 6, 2014, which claims priority to French Patent Application Serial No. 1354182, filed on May 7, 2013, both of which are incorporated by reference herein.

BACKGROUND AND SUMMARY

The present invention is applicable to the field of lubricants, and more particularly to the field of lubricants for marine engines, in particular for two-stroke marine engines. More particularly, the present invention relates to a lubricant for marine engines comprising at least one base oil, at least one overbased detergent, at least one neutral detergent and at least one fatty amine. The lubricant according to the invention can be used both with fuel oils with a high sulphur content and fuel oils with a low sulphur content. The lubricant according to the invention has sufficient neutralizing power vis-à-vis sulphuric acid formed during the combustion of fuel oils with a high sulphur content, while limiting the formation of deposits during the use of fuel oils with a low sulphur content.

The lubricant according to the invention more particularly makes it possible to prevent corrosion and/or reduce the formation of insoluble metallic salt deposits in two-stroke marine engines during the combustion of any type of fuel oils, i.e. with a high and with a low sulphur content. The lubricant according to the invention also has good properties of thermal resistance and cleanliness of the piston-cylinder assembly. The present invention also relates to a method for lubricating a marine engine, and more particularly a two-stroke marine engine that can be used both with fuel oils with a high sulphur content and fuel oils with a low sulphur content utilizing this lubricant. The present invention also relates to a composition of the additive-concentrate type comprising at least one fatty amine.

The marine oils used in slow-speed two-stroke crosshead engines are of two types: cylinder oils on the one hand, ensuring the lubrication of the piston-cylinder assembly, and system oils on the other hand, ensuring the lubrication of all the moving parts other than those of the piston-cylinder assembly. Within the piston-cylinder assembly, the combustion residues containing acid gases are in contact with the lubricant oil. The acid gases are formed during the combustion of the fuel oils; these are in particular sulphur oxides ($SO_2$, $SO_3$), which are then hydrolysed during contact with the humidity present in the combustion gases and/or in the oil. This hydrolysis generates sulphurous acid ($HSO_3$) or sulphuric acid ($H_2SO_4$).

In order to preserve the surface of the liners and prevent excessive corrosive wear, these acids have to be neutralized, which is generally carried out by reaction with the basic sites included in the lubricant. The neutralizing capacity of an oil is measured by its BN or Base Number, which characterizes its basicity. It is measured according to the standard ASTM D-2896 and is expressed in equivalents by weight of potash per gram of oil or mg of KOH/g of oil. The BN is a standard criterion making it possible to adjust the basicity of the cylinder oils to the sulphur content of the fuel oil used, in order to be able to neutralize all of the sulphur contained in the fuel, and capable of being converted to sulphuric acid by combustion and hydrolysis.

Thus, the higher the sulphur content of a fuel oil, the higher the BN of a marine oil must be. This is why marine oils with BNs varying from 5 to 100 mg KOH/g of oil are available on the market. This basicity is provided by detergents which are overbased with insoluble metallic salts, in particular metallic carbonates. The detergents, mainly of the anionic type, are for example metallic soaps of the salicylate, phenate, sulphonate, carboxylate type, etc. which form micelles where the insoluble metallic salt particles are maintained in suspension. The usual overbased detergents intrinsically have a BN conventionally comprised between 150 and 700 mg of potash per gram of detergent. Their content by mass in the lubricant is determined as a function of the level of BN to be achieved.

A part of the BN can also be provided by non-overbased or "neutral" detergents with a BN typically less than 150 mg of potash per gram of detergent. However, it is not possible to envisage producing cylinder lubricant formulas for marine engines, in particular for two-stroke marine engines, where the entire BN is provided by "neutral" detergents: it would in fact be necessary to incorporate them in excessive quantities, which could be detrimental to the efficiency of the lubricant and would not be realistic from an economic point of view.

The insoluble metallic salts of the overbased detergents, for example calcium carbonate, therefore contribute significantly to the BN of the usual lubricants. It can be considered that approximately at least 50%, typically 75%, of the BN of the cylinder lubricants is thus provided by these insoluble salts. The actual detergent part, or metallic soaps, found in both the neutral and overbased detergents, typically provides most of the remainder of the BN.

Environmental concerns have led, in certain areas and in particular coastal areas, to requirements relating to the limitation of the levels of sulphur in the fuel oils used on ships. Thus, the MARPOL Annex 6 regulations (Regulations for the Prevention of Air Pollution from Ships) issued by the IMO (International Maritime Organization) entered into force in May 2005. It sets a maximum sulphur content of 4.5% by weight with respect to the total weight of the fuel oil for heavy fuel oils as well as creating sulphur oxide emission control areas, called SECAs (SOx Emission Control Areas). By heavy fuel oils is meant high-viscosity fuels mainly used for large diesel engines installed on board ships. Thus, ships entering these areas must use fuel oils with a maximum sulphur content of 1.5% by weight with respect to the total weight of the fuel oil or any other alternative treatment aimed at limiting SOx emissions in order to comply with the specified values.

More recently, amendments have been made to the MARPOL Annexe 6 Regulations. These amendments are summarized in the table below. Thus, the restrictions on the maximum sulphur content have become more severe with a worldwide maximum content reduced from 4.5% by weight with respect to the total weight of the fuel oil to 3.5% by weight with respect to the total weight of the fuel oil. The SECAs (Sulphur Emission Control Areas) have become ECAs (Emission Control Areas) with an additional reduction in the maximum permissible sulphur content from 1.5% by weight with respect to the total weight of the fuel oil to 1.0% by weight with respect to the total weight of the fuel oil and the addition of new limits relating to contents of NOx and particles.

| | Amendments to MARPOL Annex 6 (MEPC Meeting No. 57 - April 2008) | |
|---|---|---|
| | General limit | Limit for the ECAs |
| Maximum sulphur content | 3.5% by weight with respect to the total weight of the fuel oil on Jan. 1, 2012 | 1% by weight with respect the total weight of the fuel oil on Jan. 7, 2010 |
| | 0.5% by weight with respect to the total weight of the fuel oil on Jan. 1, 2020 | 0.1% by weight with respect to the total weight of the fuel oil on Jan. 1, 2015 |

Ships sailing trans-continental routes use several types of heavy fuel oil depending on local environmental constraints whilst making it possible for them to optimize their operating costs. This situation will continue whatever the final level of the maximum sulphur content permissible in fuel oils. Thus many container ships are utilizing several bunker tanks, for a fuel oil with a high sulphur content (at most 3.5% by weight of sulphur with respect to the total weight of the fuel oil and above) or "high seas" fuel oil on the one hand, and for an "ECA" fuel oil with a sulphur content of less than or equal to 1% by weight with respect to the total weight of the fuel oil on the other hand.

Changing between these two categories of fuel oil can require adaptation of the engine's operating conditions, in particular the utilization of appropriate cylinder lubricants. At present, in the presence of fuel oil with a high sulphur content (3% by weight with respect to the total weight of the fuel oil and above), marine lubricants having a BN of the order of 70 mg of KOH/mg of lubricant are mainly used. In the presence of a fuel oil with a low sulphur content (1% by weight with respect to the total weight of the fuel oil and below), marine lubricants having a BN of the order of 40 mg of KOH/mg of lubricant are mainly recommended. In both these cases, a sufficient neutralizing capacity is then achieved as the necessary concentration at basic sites provided by the overbased detergents of the marine lubricant is reached, but it is necessary to change lubricant each time the type of fuel oil is changed.

Furthermore, each of these lubricants has limits of use for the following reasons: the use of a cylinder lubricant with a BN of 70 mg of KOH/g of lubricant in the presence of a fuel oil with a low sulphur content (1% by weight with respect to the total weight of the fuel oil and below) and a fixed level of lubrication, creates a significant excess of basic sites and a risk of destabilization of the unused overbased detergent micelles, which contain insoluble metallic salts. This destabilization results in the formation of deposits of insoluble metallic salts (for example calcium carbonate) having a high degree of hardness, mainly on the piston crown, and can in the long term lead to a risk of excessive wear of a piston-liner polishing type. As for the use of a cylinder lubricant of BN 40 mg of KOH/g of lubricant, such a BN does not provide the lubricant with sufficient neutralizing capacity and can thus lead to a significant risk of corrosion.

Thus, the optimization of the cylinder lubrication of a two-stroke engine then requires the selection of a lubricant the BN of which is suited to the sulphur content of the fuel oil used and to the engine's operating conditions. This optimization reduces the flexibility of operation of the engine and requires significant technical skill on the part of the crew in defining the conditions under which the change from one type of lubricant to the other must be carried out.

In order to simplify operations, it would therefore be desirable to have a single cylinder lubricant, in particular for two-stroke marine engines, that can be used both with high-sulphur fuel oils and with low-sulphur fuel oils. In particular, a need exists for formulations in which the BN is provided in an alternative way to the overbased detergents, by compounds that do not give rise to metallic deposits when they are present in excess relative to the quantity of sulphuric acid to be neutralized. Several solutions have been proposed in order to meet this need.

Document WO 2009/153453 describes a cylinder lubricant for two-stroke marine engines that can be used both with fuel oils with a high sulphur content and fuel oils with a low sulphur content and comprising at least one overbased detergent and at least one oil-soluble fatty amine. However, in this lubricant, the presence of a neutral detergent is optional. Furthermore, in this lubricant, the percentage by mass of overbased detergents with respect to the total weight of the lubricant is selected so that the BN provided by the metallic carbonate salts represents a contribution of at most 20 milligrams of potash per gram of lubricant to the total BN of the lubricant. Moreover, the fatty amines exemplified in this document and making it possible to improve the neutralization efficiency correspond to fatty mono- or di-amines.

Document WO 2012/140215 describes a cylinder lubricant for two-stroke marine engines that can be used both with fuel oils with a high sulphur content and fuel oils with a low sulphur content and comprising at least one overbased detergent, at least one neutral detergent and at least one alkoxylated fatty amine. However, the alkoxylated fatty amines exemplified in this document and making it possible to improve the neutralization efficiency correspond to alkoxylated fatty monoamines. Moreover, the BN of the lubricant described in this document cannot be too high, and in particular cannot be greater than 55 mg of KOH/mg of lubricant.

In addition to the constraints of neutralization efficiency vis-à-vis fuel oils with a high sulphur content and with a low sulphur content, increased thermal resistance requirements for the lubricant, and therefore cleanliness of the ring-piston-cylinder zone (or RPC zone) are to be taken into account. It would thus be desirable to have available a cylinder lubricant for marine engines, in particular for two-stroke marine engines, that can be used both with fuel oils with a high sulphur content and fuel oils with a low sulphur content and making it possible to have both a high BN, in particular of at least 50 mg KOH/g of cylinder lubricant, and a good neutralizing capacity, while having good thermal resistance and thus good cleanliness of the engine, and in particular of the piston-cylinder assembly. It would also be desirable to have available a cylinder lubricant for marine engines, in particular for two-stroke marine engines, presenting little or no risk of thickening over time, and in particular during use.

An objective of the present invention is to provide a cylinder lubricant overcoming some or all of the abovementioned drawbacks. Another objective of the present invention is to provide a cylinder lubricant that is resistant to ageing and retains its properties over time. Another objective of the invention is to provide a cylinder lubricant the formulation of which is easy to implement. Another objective of the present invention is to provide a method for lubricating a marine engine, and more particularly a two-stroke marine engine that can be used both with fuel oils with a high sulphur content and fuel oils with a low sulphur content.

The present invention relates to a cylinder lubricant having a BN that is sufficiently high to efficiently neutralize sulphuric acid formed during the use of fuel oils with a high sulphur content, a significant part of said BN being provided by oil-soluble species which do not give rise to metallic deposits when they are partially consumed during the use of fuel oils with a low sulphur content.

The present invention therefore relates to a cylinder lubricant having a BN determined according to the standard ASTM D-2896 greater than or equal to 50 milligrams of potash per gram of lubricant, comprising:

at least one lubricant base oil, at least one detergent based on alkali or alkaline-earth metals, overbased with metallic carbonate salts, at least one neutral detergent, a mixture of fatty amines comprising at least one fatty amine of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine, the percentage by mass of fatty amine with respect to the total weight of the lubricant being selected so that the BN provided by this compound represents a contribution of at least 10 milligrams of potash per gram of lubricant to the total BN of said cylinder lubricant and, the percentage by mass of the overbased detergent with respect to the total weight of the lubricant being selected so that the BN provided by the metallic carbonate salts represents a contribution of at least 20 milligrams of potash per gram of lubricant to the total BN of said cylinder lubricant.

The applicant has found that it was possible to formulate cylinder lubricants where a significant part of the BN is provided by fatty amines that are soluble in the lubricant base oil, while maintaining the level of performance with respect to standard formulations with an equivalent or even greater BN. The performances in question here are in particular the capacity to neutralize sulphuric acid, measured using the enthalpy test described hereafter, as well as thermal resistance, measured using the ECBT test also described hereafter. The cylinder lubricant according to the invention thus has such performances, while retaining a viscosity which makes it suitable for its use.

However it is not possible to completely dispense with the provision of BN by the insoluble metallic particles of the overbased detergents: in fact they constitute the "ultimate reserve" of basicity that is indispensable when operating with fuel oils with a high sulphur content, for example greater than 3% by weight with respect to the total weight of the fuel oil. These insoluble metallic salts also have a favourable anti-wear effect as long as they are maintained dispersed in the lubricant in the form of stable micelles. The applicant has also surprisingly found that in the presence of a significant provision of BN by said fatty amines, and despite a significant provision, i.e. of at least 20 mg of potash per gram of lubricant, of BN by the insoluble metallic salts of the overbased detergents, typically the metallic carbonates, the cylinder lubricant retains a good neutralizing capacity and good thermal resistance. Thus, the present invention makes it possible to formulate cylinder lubricants for marine engines, in particular for two-stroke marine engines, allowing them to be useable both with fuel oils with a high sulphur content and fuel oils with a low sulphur content and allowing them at the same time to have a high BN while maintaining the other performances of the lubricant.

Advantageously, the cylinder lubricants according to the invention have a good sulphuric acid neutralizing capacity. Advantageously, the cylinder lubricants according to the invention have a good thermal resistance. Advantageously, the cylinder lubricants according to the invention retain a good viscosity stability over time. Advantageously, the cylinder lubricants according to the invention present little or no risk of thickening as a function of the conditions of use.

In an embodiment, the cylinder lubricant according to the invention contains no fatty amines other than fatty amines corresponding to formula (I). Thus, the cylinder lubricant according to the invention can comprise one or more fatty amines of formula (I) but contains no fatty amines other than the fatty amine or amines of formula (I).

In an embodiment, the invention relates to a cylinder lubricant having a BN determined according to the standard ASTM D-2896 greater than or equal to 50 milligrams of potash per gram of lubricant, comprising:

at least one lubricant base oil, at least one detergent based on alkali or alkaline-earth metals, overbased with metallic carbonate salts, at least one neutral detergent, at least one primary, secondary or tertiary fatty monoalcohol, the alkyl chain of which is linear or branched, saturated or unsaturated and comprising at least 12 carbon atoms, preferentially from 12 to 24 carbon atoms, more preferentially from 16 to 18 carbon atoms, advantageously the primary monoalcohols with a saturated, linear alkyl chain, a mixture of fatty amines comprising at least one fatty amine of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine, the percentage by mass of fatty amine with respect to the total weight of the lubricant being selected so that the BN provided by this compound represents a contribution of at least 10 milligrams of potash per gram of lubricant to the total BN of said cylinder lubricant and, the percentage by mass of overbased detergent with respect to the total weight of the lubricant being selected so that the BN provided by the metallic carbonate salts represents a contribution of at least 20 milligrams of potash per gram of lubricant to the total BN of said cylinder lubricant.

In an embodiment, the cylinder lubricant essentially consists of:

at least one lubricant base oil, at least one detergent based on alkali or alkaline-earth metals, overbased with metallic carbonate salts, at least one neutral detergent, a mixture of fatty amines comprising at least one fatty amine of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine, the percentage by mass of fatty amine with respect to the total weight of the lubricant being selected so that the BN provided by this compound represents a contribution of at least 10 milligrams of potash per gram of lubricant to the total BN of said cylinder lubricant and, the percentage by mass of overbased detergent with respect to the total weight of the lubricant being selected so that the BN provided by the metallic carbonate salts represents a contribution of at least 20 milligrams of potash per gram of lubricant to the total BN of said cylinder lubricant.

In an embodiment, the cylinder lubricant essentially consists of:

at least one lubricant base oil, at least one detergent based on alkali or alkaline-earth metals, overbased with metallic carbonate salts, at least one neutral detergent, at least one primary, secondary or tertiary fatty monoalcohol, the alkyl chain of which is linear or branched, saturated or unsaturated and comprising at least 12 carbon atoms, preferentially from 12 to 24 carbon atoms, more preferentially from 16 to 18 carbon atoms, advantageously the primary monoalcohols with a saturated, linear alkyl chain, a mixture of fatty amines comprising at least one fatty amine of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine, the percentage by mass of fatty amine with respect to the total weight of the lubricant being selected so that the BN provided by this compound represents a contribution of at least 10 milligrams of potash per gram of lubricant to the total BN of said cylinder lubricant and, the percentage by mass of overbased detergent with respect to the total weight of the lubricant being selected so that the BN provided by the metallic carbonate salts represents a contribution of at least 20 milligrams of potash per gram of lubricant to the total BN of said cylinder lubricant.

The invention also relates to the use of a cylinder lubricant as defined above for lubricating a two-stroke marine engine. The invention also relates to the use of a cylinder lubricant as defined above as a single cylinder lubricant that can be used both with fuel oils with a sulphur content of less than 1% by weight with respect to the total weight of the fuel oil, with fuel oils with a sulphur content ranging from 1 to 3.5% by weight with respect to the total weight of the fuel oil and with fuel oils with a sulphur content greater than 3.5% by weight with respect to the total weight of the fuel oil. The invention also relates to the use of a cylinder lubricant as defined above as a single cylinder lubricant that can be used both with fuel oils with a sulphur content of less than 1% by weight with respect to the total weight of the fuel oil, with fuel oils with a sulphur content ranging from 1 to 3.5% by weight with respect to the total weight of the fuel oil and with fuel oils with a sulphur content greater than 3.5% by weight with respect to the total weight of the fuel oil. In an embodiment, the cylinder lubricant as defined above is used as a single cylinder lubricant that can be used both with fuel oils with a sulphur content of less than 1% by weight with respect to the total weight of the fuel oil and with fuel oils with a sulphur content ranging from 1 to 3.5% by weight with respect to the total weight of the fuel oil. The invention also relates to the use of a cylinder lubricant as defined above in order to prevent corrosion and/or reduce the formation of insoluble metallic salt deposits in the two-stroke marine engines during the combustion of any type of fuel oil the sulphur content of which is less than 3.5% by weight with respect to the total weight of the fuel oil.

The invention also relates to an additive concentrate, for the preparation of cylinder lubricant having a BN determined according to the standard ASTM D-2896 greater than or equal to 50 milligrams of potash per gram of lubricant, said concentrate having a BN ranging from 100 to 400 mg of potash per gram of concentrate, and comprising at least one detergent based on alkali or alkaline-earth metals, overbased with metallic carbonate salts, at least one neutral detergent and at least one fatty amine having a BN ranging from 150 to 600 mg of potash/g of amine according to the standard ASTM D-2896 and of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the percentage by mass of said fatty amine in the concentrate being selected so as to provide said concentrate with a contribution of BN determined according to the standard ASTM D-2896 ranging from 20 to 300 milligrams of potash per gram of concentrate.

The invention also relates to a method for lubricating a two-stroke marine engine comprising at least one step of bringing the engine into contact with a cylinder lubricant as defined above or obtained from the additive concentrate as described previously. The invention also relates to a method for preventing corrosion and/or reducing the formation of insoluble metallic salt deposits in two-stroke marine engines during the combustion of any type of fuel oil the sulphur content of which is less than 3.5% by weight with respect to the total weight of the fuel oil, comprising at least one step of bringing the engine into contact with a cylinder lubricant as defined above or obtained from the additive concentrate as described previously.

DETAILED DESCRIPTION

Figure 1:
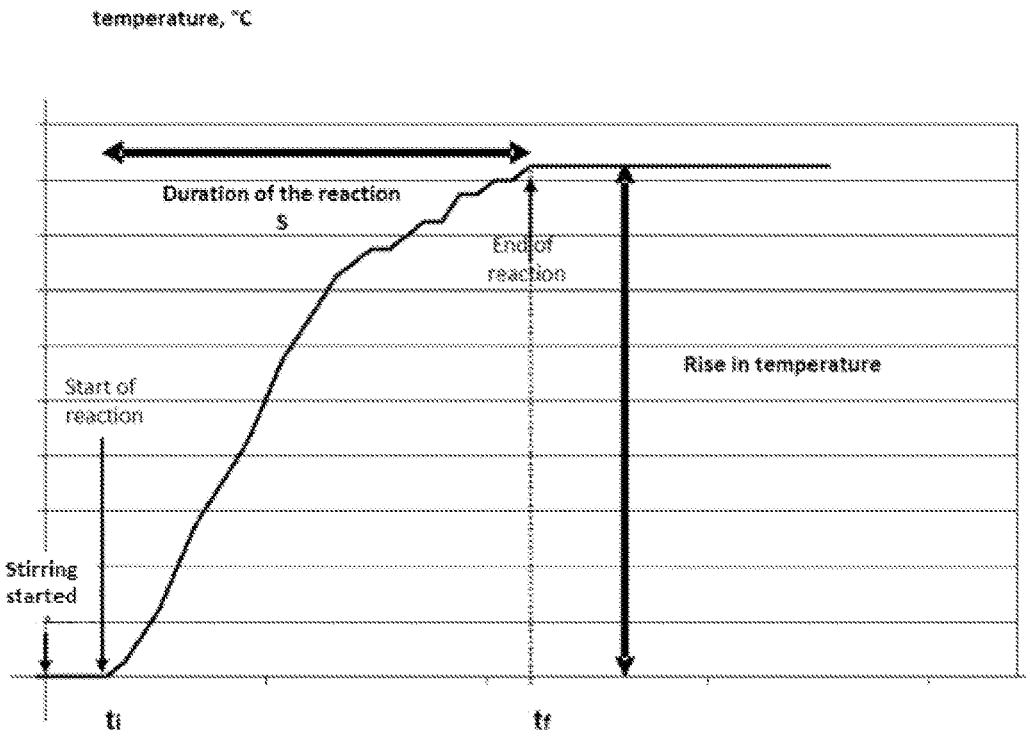
FIG. 1 is a graph illustrating neutralization reaction times.

The percentages indicated below correspond to percentages by mass of active ingredient.

Fatty Amines

The cylinder lubricant according to the invention comprises a mixture of fatty amines comprising at least one fatty amine of formula (I):

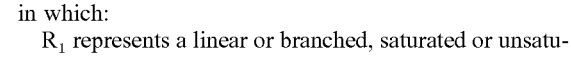

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine.

By fatty amine, is meant the fatty amine of formula (I). By mixture of fatty amines, is meant a mixture of fatty amines at least one fatty amine of which is a fatty amine of formula (I).

In an embodiment of the invention, the BN of the fatty amine determined according to the standard ASTM D-2896 can range from 250 to 600 milligrams of potash per gram of amine, preferably from 300 to 500 milligrams of potash per gram of amine. In another embodiment, the BN of the mixture of fatty amines determined according to the standard ASTM D-2896 can range from 250 to 600 milligrams of potash per gram of amine, preferably from 300 to 500 milligrams of potash per gram of amines.

The fatty amines are mainly obtained from carboxylic acids. The starting fatty acids for obtaining fatty amines according to the invention can be selected from the myristic, pentadecylic, palmitic, margaric, stearic, nonadecylic, arachidic, heneicosanoic, behenic, tricosanoic, lignoceric, pentacosanoic, cerotic, heptacosanoic, montanic, nonacosanoic, melissic, hentriacontanoic, laceroic acids or from the unsaturated fatty acids such as palmitoleic, oleic, erucic, nervonic, linoleic, a-linolenic, gamma-linolenic, di-homo-gamma-linolenic, arachidonic, eicosapentaenoic, docosahexaenoic acid. The preferred fatty acids can have originated from the hydrolysis of the triglycerides present in vegetable and animal oils, such as coconut, palm, olive, peanut, rapeseed, sunflower, soya, cotton, linseed oil, beef tallow, etc.

The natural oils can have been genetically modified so as to enrich their content of certain fatty acids. By way of example, rapeseed oil or oleic sunflower oil may be mentioned. In an embodiment, the fatty amines used in the lubricants according to the invention can be obtained from natural, vegetable or animal resources.

In an embodiment of the invention, the mixture of fatty amines comprises at least one fatty amine of formula (I) in which $R_1$ represents a linear or branched, saturated or unsaturated alkyl group comprising from 14 to 22 carbon atoms, preferably from 16 to 20 carbon atoms. In another embodiment of the invention, the mixture of fatty amines comprises at least one fatty amine of formula (I) in which $R_2$ represents a hydrogen atom.

In another preferred embodiment of the invention, the mixture of fatty amines comprises at least one fatty amine of formula (I) in which:

$R_1$ represents a linear or branched, saturated or unsaturated alkyl group comprising from 14 to 22 carbon atoms, preferably from 16 to 20 carbon atoms, and $R_2$ represents a hydrogen atom.

In another preferred embodiment of the invention, the mixture of fatty amines is presented in the form:

of at least one fatty amine of formula (I) in which $R_1$ represents a linear or branched, saturated or unsaturated alkyl group comprising from 14 to 16 carbon atoms and $R_2$ represents a hydrogen atom, of at least one fatty amine of formula (I) in which $R_1$ represents a linear or branched, saturated or unsaturated alkyl group comprising at least 18 carbon atoms and $R_2$ represents a hydrogen atom, and of at least one fatty amine of formula (I) in which $R_1$ represents a linear or branched, saturated or unsaturated alkyl group comprising at least 20 carbon atoms and $R_2$ represents a hydrogen atom.

In a more preferred embodiment of the invention, the mixture of fatty amines is presented in the form:

of at least one fatty amine of formula (I) in which $R_1$ represents a linear or branched, saturated or unsaturated alkyl group comprising from 14 to 16 carbon atoms and $R_2$ represents a hydrogen atom, of at least one fatty amine of formula (I) in which $R_1$ represents a linear or branched, saturated or unsaturated alkyl group comprising at least 18 carbon atoms and $R_2$ represents a hydrogen atom, and of at least one fatty amine of formula (I) in which $R_1$ represents a linear or branched, saturated or unsaturated alkyl group comprising at least 20 carbon atoms and $R_2$ represents a hydrogen atom, the sum of the content by weight of said fatty amines of formula (I) being greater than or equal to 90% and strictly less than 100% with respect to the weight of said mixture of fatty amines.

In another preferred embodiment of the invention, the mixture of fatty amines is presented in the form:

of at least one fatty amine of formula (I) in which $R_1$ represents a linear or branched unsaturated alkyl group comprising from 16 to 20 carbon atoms, preferably from 18 to 20 carbon atoms and $R_2$ represents a hydrogen atom, and of at least one fatty amine of formula (I) in which $R_1$ represents a linear or branched saturated alkyl group comprising from 16 to 20 carbon atoms, preferably from 18 to 20 carbon atoms and $R_2$ represents a hydrogen atom.

In a more preferred embodiment of the invention, the mixture of fatty amines is presented in the form:

of at least one fatty amine of formula (I) in which $R_1$ represents a linear or branched unsaturated alkyl group comprising from 16 to 20 carbon atoms, preferably from 18 to 20 carbon atoms and $R_2$ represents a hydrogen atom, of at least one fatty amine of formula (I) in which $R_1$ represents a linear or branched saturated alkyl group comprising from 16 to 20 carbon atoms, preferably from 18 to 20 carbon atoms and $R_2$ represents a hydrogen atom, the sum of the content by weight of said fatty amines of formula (I) being greater than or equal to 90% and strictly less than 100% with respect to the weight of said mixture of fatty amines.

The products Tetrameen OV and Tetrameen T marketed by the company Akzo Nobel may be mentioned as examples of mixtures of fatty amines according to the invention. The percentage by mass of fatty amine with respect to the total weight of the cylinder lubricant according to the invention is selected so that the BN provided by this compound represents a contribution of at least 10 milligrams of potash per gram of lubricant to the total BN of said cylinder lubricant.

The part of BN provided by a fatty amine in the cylinder lubricant according to the invention (in milligrams of potash per gram of finished lubricant, or BN "points") is calculated from its intrinsic BN measured according to the standard ASTM D-2896 and its percentage by mass in the finished lubricant:

amine BN lub=x. amine BN/100 amine BN lub=contribution of the amine to the BN of the finished lubricant x=% by mass of the amine in the finished lubricant amine BN=intrinsic BN of the amine alone (ASTM D-2896).

In an embodiment of the invention, the percentage by mass of fatty amine with respect to the total weight of the cylinder lubricant is selected so that the BN provided by this compound represents a contribution of 10 to 60 milligrams of potash per gram of lubricant, more preferentially from 10 to 30 milligrams of potash per gram of lubricant, to the total BN of said cylinder lubricant. In another embodiment of the invention, the percentage by mass of fatty amine with respect to the total weight of the cylinder lubricant is selected so that the BN provided by this compound represents at least 10%, preferably 10 to 50%, more preferentially 10 to 30% of the total BN of said cylinder lubricant. In another embodiment of the invention, the percentage by mass of the mixture of fatty amines with respect to the total weight of cylinder lubricant ranges from 2 to 10%. In another embodiment of the invention, the percentage by mass of the mixture of fatty amines with respect to the total weight of cylinder lubricant ranges from 2 to 6%.

In a preferred embodiment, the cylinder lubricant according to the invention contains no fatty amines other than fatty amines corresponding to formula (I). In another embodiment of the invention, the cylinder lubricant can comprise at least one other additional fatty amine different from the fatty amines corresponding to formula (I). The additional fatty amine can be selected from the monoamines, the diamines, the fatty triamines, non-alkoxylated or alkoxylated. In a preferred embodiment of the invention, the content by weight of fatty amine of formula (I) is strictly less than 100% with respect to the total weight of the mixture of fatty amines. In a preferred embodiment of the invention, the content by weight of fatty amine of formula (I) ranges from 90 to 99.9% with respect to the total weight of the mixture of fatty amines.

Overbased or Neutral Detergents

The cylinder lubricant according to the invention comprises at least one detergent based on alkali or alkaline-earth metals, overbased with metallic carbonate salts and at least one neutral detergent, the percentage by mass of the overbased detergent with respect to the total weight of the lubricant being selected so that the BN provided by the metallic carbonate salts represents a contribution of at least 20 milligrams of potash per gram of lubricant to the total BN of said cylinder lubricant. The detergents used in the cylinder lubricants according to the present invention are well known to a person skilled in the art. The detergents commonly used in the formulation of lubricants are typically anionic compounds comprising a long lipophilic hydrocarbon-containing chain and a hydrophilic head. The associated cation is typically a metallic cation of an alkali or alkaline-earth metal.

The detergents are preferentially selected from the salts of alkali or alkaline-earth metals of carboxylic acids, sulphonates, salicylates, naphthenates, as well as the salts of phenates. The alkali and alkaline-earth metals are preferentially calcium, magnesium, sodium or barium.

These metallic salts can contain the metal in an approximately stoichiometric quantity with respect to the anionic group(s) of the detergent. In this case, the term non-overbased or "neutral" detergents is used, although they also provide a certain basicity. These "neutral" detergents typically have a BN, measured according to ASTM D2896, less than 150 mg KOH/g, or less than 100 mg KOH/g, or even less than 80 mg KOH/g of detergent.

This type of detergents referred to as neutral can partially contribute to the BN of the cylinder lubricants according to the present invention. For example neutral detergents of the following types: carboxylates, sulphonates, salicylates, phenates, naphthenates of alkali and alkaline-earth metals, for example of calcium, sodium, magnesium, barium will be used.

When the metal is in excess (in a quantity greater than the stoichiometric quantity with respect to the anionic group(s) of the detergent), we are dealing with detergents referred to as overbased. Their BN is high, greater than 150 mg KOH/g of detergent, typically ranging from 200 to 700 mg KOH/g of detergent, preferentially from 250 to 450 mg KOH/g of detergent. The metal in excess providing the detergent with its overbased character is presented in the form of metallic salts that are insoluble in oil, for example carbonate, hydroxide, oxalate, acetate, glutamate, preferentially carbonate.

In one and the same overbased detergent, the metals of these insoluble salts can be the same as those of the oil-soluble detergents or be different. They are preferentially selected from calcium, magnesium, sodium or barium. The overbased detergents are thus presented in the form of micelles composed of insoluble metallic salts maintained in suspension in the cylinder lubricant by the detergents in the form of oil-soluble metallic salts.

These micelles can contain one or more types of insoluble metallic salts, stabilized by one or more types of detergent. The overbased detergents comprising a single type of detergent-soluble metallic salt are generally named after the nature of the hydrophobic chain of the latter detergent. Thus, they are referred to as being of the phenate, salicylate, sulphonate, naphthenate type according to whether this detergent is a phenate, salicylate, sulphonate, or naphthenate respectively. The overbased detergents are referred to as being of mixed type if the micelles comprise several types of detergents, differing from each other by the nature of their hydrophobic chain.

In an embodiment of the invention, the overbased detergent and the neutral detergent can be selected from the carboxylates, sulphonates, salicylates, naphthenates, phenates, and the mixed detergents combining at least two of these types of detergents. In a preferred embodiment of the invention, the overbased detergent and the neutral detergent are compounds based on metals selected from calcium, magnesium, sodium or barium, preferentially calcium or magnesium. In another preferred embodiment of the invention, the overbased detergent is overbased with insoluble metallic salts selected from the group of the carbonates of alkali and alkaline-earth metals, preferentially calcium carbonate. In another preferred embodiment of the invention, the overbased detergent is selected from the phenates, sulphonates, salicylates and the mixed phenate-sulphonate-salicylate detergents, overbased with calcium carbonate, more preferentially sulphonates and phenates overbased with calcium carbonate.

In the cylinder lubricants according to the invention, a part of the BN is provided by the insoluble metallic salts of the overbased detergent, in particular the metallic carbonates. The BN provided by the metallic carbonate salts (or carbonate BN or $BN_{CaCO3}$) is measured on the overbased detergent alone and/or on the final lubricant according to the method described hereafter. Typically in an overbased detergent, the BN provided by the metallic carbonate salts represents from 50 to 95% of the total BN of the overbased detergent alone. It is to be noted that certain neutral detergents also comprise a certain content (much lower than the overbased detergents) of insoluble metallic salts (calcium carbonate), and can themselves contribute to the carbonate BN.

In an embodiment of the invention, the percentage by mass of the overbased detergent with respect to the total weight of the cylinder lubricant is selected so that the BN provided by the metallic carbonate salts represents a contribution ranging from 20 to 90 milligrams of potash per gram of lubricant, preferentially from 30 to 70 milligrams of potash per gram of lubricant, to the total BN of said cylinder lubricant. In another embodiment of the invention, the percentage by mass of the overbased detergent with respect to the total weight of the cylinder lubricant is selected so that the BN provided by the metallic carbonate salts represents a contribution strictly greater than 20 milligrams of potash per gram of lubricant to the total BN of said cylinder lubricant. In a preferred embodiment of the invention, the percentage by mass of the overbased detergent with respect to the total weight of the cylinder lubricant is selected so that the BN provided by the metallic carbonate salts represents a contribution greater than 20 milligrams of potash per gram of lubricant and less than or equal to 90 milligrams of potash per gram of lubricant and below, preferably ranging from 30 to 70 milligrams of potash per gram of lubricant to the total BN of said cylinder lubricant.

These insoluble metallic salts have a favourable anti-wear effect as long as they are maintained dispersed in the lubricant in the form of stable micelles. Moreover, the actual detergents, which can be detergent soaps of the essentially phenate, sulphonate, or salicylate type, also contribute to the BN of the cylinder lubricants according to the invention.

The BN of the cylinder lubricants according to the invention, measured according to ASTM D2896 therefore comprises several distinct components, including at least:

1) The BN provided by the insoluble metallic salts of the overbased and neutral detergents, called by extension "carbonate BN" or "$BN_{CaCO3}$", and measured by the method described hereafter, 2) The additional BN, hereafter denoted "organic BN", which can be measured by the difference between the total ASTM D-2896 BN of the lubricant and its carbonate BN, and provided:
   - by the metallic soaps of the overbased and optionally neutral detergents,
   - by the fatty amines, (this amine BN being determined as a function of the BN of the amines measured by ASTM D-2896 and the percentage by mass of fatty amines).

In an embodiment of the invention, the percentage by mass of the overbased detergent and of the neutral detergent with respect to the total weight of the cylinder lubricant, is selected so that the organic BN provided by the detergent soaps can represent a contribution of at least 10 milligrams of potash per gram of lubricant, preferentially ranging from 10 to 60 milligrams of potash per gram of lubricant, more preferentially from 10 to 40 milligrams of potash per gram of lubricant to the total BN of said cylinder lubricant. In another embodiment of the invention, the percentage by mass of the overbased detergent with respect to the total weight of cylinder lubricant can range from 8 to 30%, preferably from 10 to 30%. In another embodiment of the invention, the percentage by mass of the neutral detergent with respect to the total weight of cylinder lubricant can range from 5 to 15%, preferably from 5 to 10%.

The BN of the cylinder lubricants according to the present invention is provided by at least one overbased detergent based on alkali or alkaline-earth metals, at least one neutral detergent and at least one fatty amine of formula (I). The value of this BN, measured according to the standard ASTM D-2896 is greater than or equal to 50 milligrams of potash per gram of lubricant. The BN of a cylinder lubricant for marine engines will be selected depending on the conditions of use of said lubricants and in particular according to the sulphur content of the fuel oil used in association with said cylinder lubricants. In an embodiment of the invention, the BN of the cylinder lubricant can range from 50 to 100 milligrams of potash per gram of lubricant, preferably from 60 to 90 milligrams of potash per gram of lubricant. In a preferred embodiment of the invention, the BN of the cylinder lubricant ranges from 65 to 80 milligrams of potash per gram of lubricant, preferably from 65 to 75 milligrams of potash per gram of lubricant.

Lubricant Base Oils

In general, the lubricant base oils used for the formulation of cylinder lubricants according to the present invention can be oils of mineral, synthetic or vegetable origin as well as mixtures thereof. The mineral or synthetic oils generally used in the application belong to one of groups I to V according to the classes defined in the API classification (or their equivalents according to the ATIEL classification) as summarized below. Moreover, the lubricant base oil(s) used in the cylinder lubricants according to the invention can be selected from the oils of synthetic origin of group VI according to the ATIEL classification. The API classification is defined in American Petroleum Institute 1509 "Engine oil Licensing and Certification System" 17th edition, September 2012. The ATIEL classification is defined in "The ATIEL Code of Practice", number 18, November 2012.

| | Saturates content | Sulphur content | Viscosity index |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |

-continued

| | Saturates content | Sulphur content | Viscosity index |
|---|---|---|---|
| Group III Hydrocracked or hydro-isomerized oils | ≥90% | ≤0.03% | ≥120 |
| Group IV | PAO (Poly alpha olefins) | | |
| Group V | Esters and other bases not included in bases of groups I to IV | | |
| Group VI* | Poly Internal Olefins (PIO) | | |

*for the ATIEL classification only

The mineral oils of Group I can be obtained by distillation of selected naphthenic or paraffinic crudes then purification of these distillates by processes such as solvent extraction, solvent or catalytic dewaxing, hydrotreatment or hydrogenation. The oils of Groups II and III are obtained by more severe purification processes, for example a combination of hydrotreating, hydrocracking, hydrogenation and catalytic dewaxing. The examples of synthetic bases of Group IV and V include the polyisobutenes, alkylbenzenes and poly alpha olefins such as the polybutenes.

These lubricant base oils can be used alone or in a mixture. A mineral oil can be combined with a synthetic oil. Cylinder oils for two-stroke marine engines have a viscosimetric grade of SAE-40 to SAE-60, generally SAE-50 equivalent to a kinematic viscosity at 100° C. comprised between 16.3 and 21.9 $mm^2/s$ measured according to the standard ASTM D445. The oils of grade SAE-40 have a kinematic viscosity at 100° C. comprised between 12.5 and 16.3 cSt measured according to the standard ASTM D445. The oils of grade SAE-50 have a kinematic viscosity at 100° C. comprised between 16.3 and 21.9 cSt measured according to the standard ASTM D445. The oils of grade SAE-60 have a kinematic viscosity at 100° C. comprised between 21.9 and 26.1 cSt measured according to the standard ASTM D445.

In a preferred embodiment of the invention, the cylinder lubricants have a kinematic viscosity measured according to the standard ASTM D445 at 100° C. ranging from 12.5 to 26.1 cSt, preferentially from 16.3 to 21.9 cSt. This viscosity can be obtained by mixing additives and base oils for example containing mineral bases of Group I such as Neutral Solvent bases (for example 500 NS or 600 NS) and Brightstock. Any other combination of bases, mineral, synthetic or of vegetable origin having, in a mixture with the additives, a viscosity compatible with the grade SAE-50 can be used.

Typically, a standard formulation of cylinder lubricant for two-stroke marine engines is of grade SAE-40 to SAE-60, preferentially SAE-50 (according to the classification SAE J300) and comprises at least 40% by weight of lubricant base oil of mineral, or synthetic origin or mixtures thereof, adapted to use for a marine engine. For example, a lubricant base oil of group I according to the API classification, i.e. obtained by the following operations: distillation of selected crudes then purification of these distillates by processes such as solvent extraction, solvent or catalytic dewaxing, hydrotreatment or hydrogenation, can be used for the formulation of a cylinder lubricant. The lubricant base oils of group I have a Viscosity Index (VI) ranging from 80 to 120; their sulphur content is greater than 0.03% and their content of saturated hydrocarbon-containing compounds is less than 90%.

Typically, a standard formulation of cylinder lubricant for two-stroke marine engines contains from 18 to 25% by weight, with respect to the total weight of lubricant, of a group I base oil of BSS type (distillation residue, with a kinematic viscosity of 100° C. of approximately 30 $mm^2/s$, typically from 28 to 32 $mm^2/s$, and with a density at 15° C. ranging from 895 to 915 $kg/m^3$), and from 50 to 60% by weight, with respect to the total weight of lubricant, of a group I base oil of the 600 NS type (distillate, with a density at 15° C. ranging from 880 to 900 $kg/m^3$, with a kinematic viscosity of 100° C. of approximately 12 $mm^2/s$).

Other Additives

In an embodiment of the invention, the cylinder lubricant can also comprise an additional compound selected from:

- the primary, secondary or tertiary fatty monoalcohols, the alkyl chain of which is linear or branched, saturated or unsaturated and comprising at least 12 carbon atoms, preferentially from 12 to 24 carbon atoms, more preferentially from 16 to 18 carbon atoms, advantageously the primary monoalcohols with a saturated, linear alkyl chain,
- the esters of saturated fatty monoacids comprising at least 14 carbon atoms and alcohols comprising at most 6 carbon atoms, preferentially the mono- and diesters, advantageously the monoesters of monoalcohols and the diesters of polyols, the ester functions of which are at a distance of four carbon atoms at most, counting from the oxygen side of the ester function.

In a preferred embodiment of the invention, the cylinder lubricant also comprises an additional compound selected from the primary, secondary or tertiary fatty monoalcohols, the alkyl chain of which is linear or branched, saturated or unsaturated and comprising from 16 to 18 carbon atoms, advantageously the primary monoalcohols with a saturated, linear alkyl chain. In an embodiment of the invention, the content of additional compound as defined above ranges from 0.01 to 10%, preferably from 0.1 to 2% by weight with respect to the total weight of the cylinder lubricant.

The cylinder lubricant can also comprise at least one other additional additive selected from the dispersants, the anti-wear additives or any other functional additive. The dispersants are well-known additives used in the lubricant composition formulation, in particular for application in the marine field. Their primary role is to maintain in suspension the particles initially present or appearing in the lubricant during its use in the engine. They prevent their agglomeration by acting on the steric hindrance. They can also have a synergistic effect on neutralization.

The dispersants used as lubricant additives typically contain a polar group, associated with a relatively long hydrocarbon-containing chain, generally containing from 50 to 400 carbon atoms. The polar group typically contains at least one nitrogen, oxygen or phosphorus element.

The compounds derived from succinic acid are dispersants particularly used as lubrication additives. In particular succinimides obtained by condensation of succinic anhydrides and amines, the succinic esters obtained by condensation of succinic anhydrides and of alcohols or polyols are used. These compounds can then be treated with various compounds in particular sulphur, oxygen, formaldehyde, carboxylic acids and compounds containing boron or zinc in order to produce for example borated succinimides or zinc-blocked succinimides.

Mannich bases, obtained by polycondensation of phenols substituted with alkyl groups, formaldehyde and primary or secondary amines, are also compounds used as dispersants in the lubricants. In an embodiment of the invention, the dispersant content can be greater than or equal to 0.1%, preferably from 0.5 to 2%, advantageously from 1 to 1.5% by weight with respect to the total weight of the cylinder lubricant.

The anti-wear additives protect the friction surfaces by forming a protective film adsorbed on these surfaces. The most commonly used is zinc dithiophosphate or DTPZn. Various phosphorus-, sulphur-, nitrogen-, chlorine- and boron-containing compounds are also found in this category.

A great variety of anti-wear additives exists, but the most frequently used category is that of the phospho sulphur-containing additives such as the metallic alkylthiophosphates, in particular zinc alkylthiophosphates, and more specifically zinc dialkyldithiophosphates or DTPZn. The preferred compounds are of formula $Zn((SP(S)(OR_3)(OR_4))_2$, wherein $R_3$ and $R_4$ are alkyl groups, preferentially comprising from 1 to 18 carbon atoms. The DTPZn is typically present in contents of the order of 0.1 to 2% by weight with respect to the total weight of the cylinder lubricant.

The amine phosphates, the polysulphides, in particular the sulphur-containing olefins, are also commonly-used anti-wear additives. Anti-wear and extreme pressure additives of the nitrogen- and sulphur-containing type, such as for example the metallic dithiocarbamates, in particular molybdenum dithiocarbamate, are also usually found in cylinder lubricants. The glycerol esters are also anti-wear additives. For example the mono-, di and trioleates, monopalmitates and monomyristates may be mentioned. In an embodiment, the anti-wear additive content ranges from 0.01 to 6%, preferentially from 0.1 to 4% by weight with respect to the total weight of the cylinder lubricant.

The other functional additives can be selected from the thickeners and the anti-foaming additives in order to counteract the effect of the detergents, which can be for example polar polymers such as polymethylsiloxanes, polyacrylates, the anti-oxidant and/or anti-rust additives, for example organo-metallic detergents or thiadiazoles. The latter are known to a person skilled in the art. These additives are generally present in a content by weight of 0.1 to 5% with respect to the total weight of the cylinder lubricant.

In a preferred embodiment of the invention, the cylinder lubricant comprises:

- from 55 to 85% of at least one base oil,
- from 2 to 10% of a mixture of fatty amines comprising at least one fatty amine of formula (I) and in which the content by weight of fatty amine of formula (I) is greater than or equal to 90%, preferentially strictly less than 100%, advantageously from 90 to 99.9% with respect to the total weight of the mixture of fatty amines,
- from 8 to 30% of at least one detergent based on alkali or alkaline-earth metals, overbased with metallic carbonate salts,
- from 5 to 15% of at least one neutral detergent.

In another preferred embodiment of the invention, the cylinder lubricant essentially consists of:

- 55 to 85% of at least one base oil,
- 2 to 10% of a mixture of fatty amines comprising at least one fatty amine of formula (I) and in which the content by weight of fatty amine of formula (I) is greater than or equal to 90%, preferentially strictly less than 100%, advantageously from 90 to 99.9% with respect to the total weight of the mixture of fatty amines,
- 8 to 30% of at least one detergent based on alkali or alkaline-earth metals, overbased with metallic carbonate salts,
- 5 to 15% of at least one neutral detergent.

All of the characteristics and preferences presented for the base oil, the fatty amine, the overbased detergent and the neutral detergent, the contribution of the fatty amine of formula (I) and the contribution of the overbased detergent to the total BN of the lubricant also apply to the above cylinder lubricants.

In a preferred embodiment of the invention, the cylinder lubricant comprises:

- from 45 to 84.99% of at least one base oil,
- from 2 to 10% of a mixture of fatty amines comprising at least one fatty amine of formula (I) and in which the content by weight of fatty amine of formula (I) is greater than or equal to 90%, preferentially strictly less than 100%, advantageously from 90 to 99.9% with respect to the total weight of the mixture of fatty amines,
- from 8 to 30% of at least one detergent based on alkali or alkaline-earth metals, overbased with metallic carbonate salts,
- from 5 to 15% of at least one neutral detergent,
- from 0.01 to 10% of at least one additional compound selected from the primary, secondary or tertiary fatty monoalcohols, the alkyl chain of which is linear or branched, saturated or unsaturated and comprising at least 12 carbon atoms, preferentially from 12 to 24 carbon atoms, more preferentially from 16 to 18 carbon atoms, advantageously the primary monoalcohols with a saturated, linear alkyl chain.

In another preferred embodiment of the invention, the cylinder lubricant essentially consists of:

- 45 to 84.99% of at least one base oil,
- 2 to 10% of a mixture of fatty amines comprising at least one fatty amine of formula (I) and in which the content by weight of fatty amine of formula (I) is greater than or equal to 90%, preferentially strictly less than 100%, advantageously from 90 to 99.9% with respect to the total weight of the mixture of fatty amines,
- 8 to 30% of at least one detergent based on alkali or alkaline-earth metals, overbased with metallic carbonate salts,
- 5 to 15% of at least one neutral detergent,
- 0.01 to 10% of at least one additional compound selected from the primary, secondary or tertiary fatty monoalcohols, the alkyl chain of which is linear or branched, saturated or unsaturated and comprising at least 12 carbon atoms, preferentially from 12 to 24 carbon atoms, more preferentially from 16 to 18 carbon atoms, advantageously the primary monoalcohols with a saturated, linear alkyl chain.

All of the characteristics and preferences presented for the base oil, the fatty amine, overbased detergent, neutral detergent and additional compound, the contribution of the fatty amine of formula (I) and the contribution of the overbased detergent to the total BN of the lubricant also apply to the above cylinder lubricants.

A subject of the invention is also the use of a cylinder lubricant as defined above for lubricating a two-stroke marine engine. All of the characteristics and preferences presented for the cylinder lubricant also apply to the above use.

A subject of the invention is also the use of a cylinder lubricant as defined above as a single cylinder lubricant that can be used both with fuel oils with a sulphur content of less than 1% by weight with respect to the total weight of the fuel oil, with fuel oils with a sulphur content ranging from 1 to 3.5% by weight with respect to the total weight of the fuel oil and with fuel oils with a sulphur content greater than 3.5% by weight with respect to the total weight of the fuel oil. In an embodiment, a subject of the invention is the use of a cylinder lubricant as defined above as a single cylinder lubricant that can be used both with fuel oils with a sulphur content of less than 1% by weight with respect to the total weight of the fuel oil and with fuel oils with a sulphur content ranging from 1 to 3.5% by weight with respect to the total weight of the fuel oil. All of the characteristics and preferences presented for the cylinder lubricant also apply to the above use.

A subject of the invention is also the use of a cylinder lubricant as defined above in order to prevent corrosion and/or reduce the formation of insoluble metallic salt deposits in two-stroke marine engines during the combustion of any type of fuel oil the sulphur content of which is less than or equal to 3.5% by weight with respect to the total weight of the fuel oil. All of the characteristics and preferences presented for the cylinder lubricant also apply to the above use.

The compounds as defined above and contained in the cylinder lubricant according to the invention, and more particularly the fatty amine of formula (I), the detergent based on alkali or alkaline-earth metals, overbased with metallic carbonate salts and the neutral detergent, can be incorporated in the cylinder lubricant as separate additives, in particular by the separate addition thereof to the base oils. However, they can also be incorporated in an additive concentrate for cylinder lubricants.

Thus, a subject of the invention is also an additive concentrate for the preparation of cylinder lubricant having a BN determined according to the standard ASTM D-2896 greater than or equal to 50 milligrams of potash per gram of lubricant, said concentrate having a BN ranging from 100 to 400 mg of potash per gram of concentrate, and comprising at least one detergent based on alkali or alkaline-earth metals, overbased with metallic carbonate salts, at least one neutral detergent and at least one fatty amine having a BN ranging from 150 to 600 mg of potash/g of amine according to the standard ASTM D-2896 and of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group, the percentage by mass of said fatty amine in the concentrate being selected so as to provide said concentrate with a contribution of BN determined according to the standard ASTM D-2896 ranging from 20 to 300 milligrams of potash per gram of concentrate.

All of the characteristics and preferences presented for the fatty amine of formula (I) also apply to the above additive concentrate.

In an embodiment of the invention, the additive concentrate can comprise:

at least one detergent based on alkali or alkaline-earth metals, overbased with metallic carbonate salts, at least one neutral detergent, at least one additional compound selected from the primary, secondary or tertiary fatty monoalcohols, the alkyl chain of which is linear or branched, saturated or unsaturated, and comprising at least 12 carbon atoms, preferentially from 12 to 24 carbon atoms, more preferentially from 16 to 18 carbon atoms, advantageously the primary monoalcohols with a saturated, linear alkyl chain.

at least one fatty amine having a BN ranging from 150 to 600 mg of potash/g of amine according to the standard ASTM D-2896 and of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group.

In another embodiment of the invention, the additive concentrate can comprise:

from 30 to 71% of at least one detergent based on alkali or alkaline-earth metals, overbased with metallic carbonate salts, from 20 to 50% of at least one neutral detergent, from 9 to 30% of at least one fatty amine having a BN ranging from 150 to 600 mg of potash/g of amine according to the standard ASTM D-2896 and of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group.

In another embodiment of the invention, the additive concentrate can comprise:

from 30 to 70.6% of at least one detergent based on alkali or alkaline-earth metals, overbased with metallic carbonate salts, from 20 to 50% of at least one neutral detergent, from 0.4 to 25% of at least one additional compound selected from the primary, secondary or tertiary fatty monoalcohols, the alkyl chain of which is linear or branched, saturated or unsaturated and comprising at least 12 carbon atoms, preferentially from 12 to 24 carbon atoms, more preferentially from 16 to 18 carbon atoms, advantageously the primary monoalcohols with a saturated, linear alkyl chain.

from 9 to 30% of at least one fatty amine having a BN ranging from 150 to 600 mg of potash/g of amine according to the standard ASTM D-2896 and of formula (I):

$$R_1—[NR_2(CH_2)_3]_3—NH_2 \quad (I)$$

in which:

$R_1$ represents a linear or branched, saturated or unsaturated alkyl group, comprising at least 14 carbon atoms, $R_2$ represents a hydrogen atom or a $—(CH_2)_2OH$ group.

All of the characteristics and preferences presented for the fatty amine, overbased detergent, neutral detergent and additional compound also apply to the above additive concentrates. In an embodiment of the invention, at least one base oil can be added to the additive concentrate according to the invention in order to obtain a cylinder lubricant according to the invention.

Another subject of the invention relates to a method for lubricating a two-stroke marine engine, said method comprising at least one step of bringing the engine into contact with a cylinder lubricant as described previously or obtained from an additive concentrate as described previously. All of the characteristics and preferences presented for the cylinder lubricant or for the additive concentrate also apply to the above lubrication method.

Another subject of the invention relates to a method for preventing corrosion and/or reducing the formation of insoluble metallic salt deposits in two-stroke marine engines during the combustion of any type of fuel oil the sulphur content of which is less than 3.5% with respect to the total weight of the fuel oil, comprising at least one step of bringing the engine into contact with a cylinder lubricant as defined above or obtained from the additive concentrate as described previously. All of the characteristics and preferences presented for the cylinder lubricant or for the additive concentrate also apply to the above method.

The different subjects of the present invention and their implementations will be better understood on reading the following examples. These examples are given as an indication, without being limitative in nature.

Method for Measuring the Contribution of the Insoluble Metallic Salts Present in the Overbased Detergents to the BN of the Cylinder Lubricants Containing Said Overbased Detergents The method making it possible to measure the contribution of the insoluble metallic salts present in the overbased detergents to the BN of the cylinder lubricants containing said overbased detergents is defined as follows:

The total measurement of the basicity (referred to as BN or Base Number) of the cylinder lubricants or of the overbased detergents is carried out by the method ASTM D2896. This BN is composed of two distinct forms:

carbonate BN, provided by overbasing the detergent with metallic carbonates, generally calcium carbonate, hereafter denoted "$BN_{CaCO3}$", so-called organic BN provided by the metallic soap of the detergent of the essentially phenate or salicylate, or sulphonate type.

Carbonate BN, hereafter denoted $BN_{CaCO3}$ is measured, on the cylinder lubricant or the overbased detergents alone, according to the following procedure. This operates on the principle of attacking the overbasing, (calcium) carbonate, of the sample with sulphuric acid. This carbonate is converted to calcium sulphate with release of carbonic gas following the reaction;

$$Ca\,CO_3 + H_2\,SO_4 \longrightarrow Ca\,SO_4 + H_2O + CO_2 \nearrow$$

The volume of the reactor being constant, the pressure increases in proportion to the release of $CO_2$.

Figure 2:
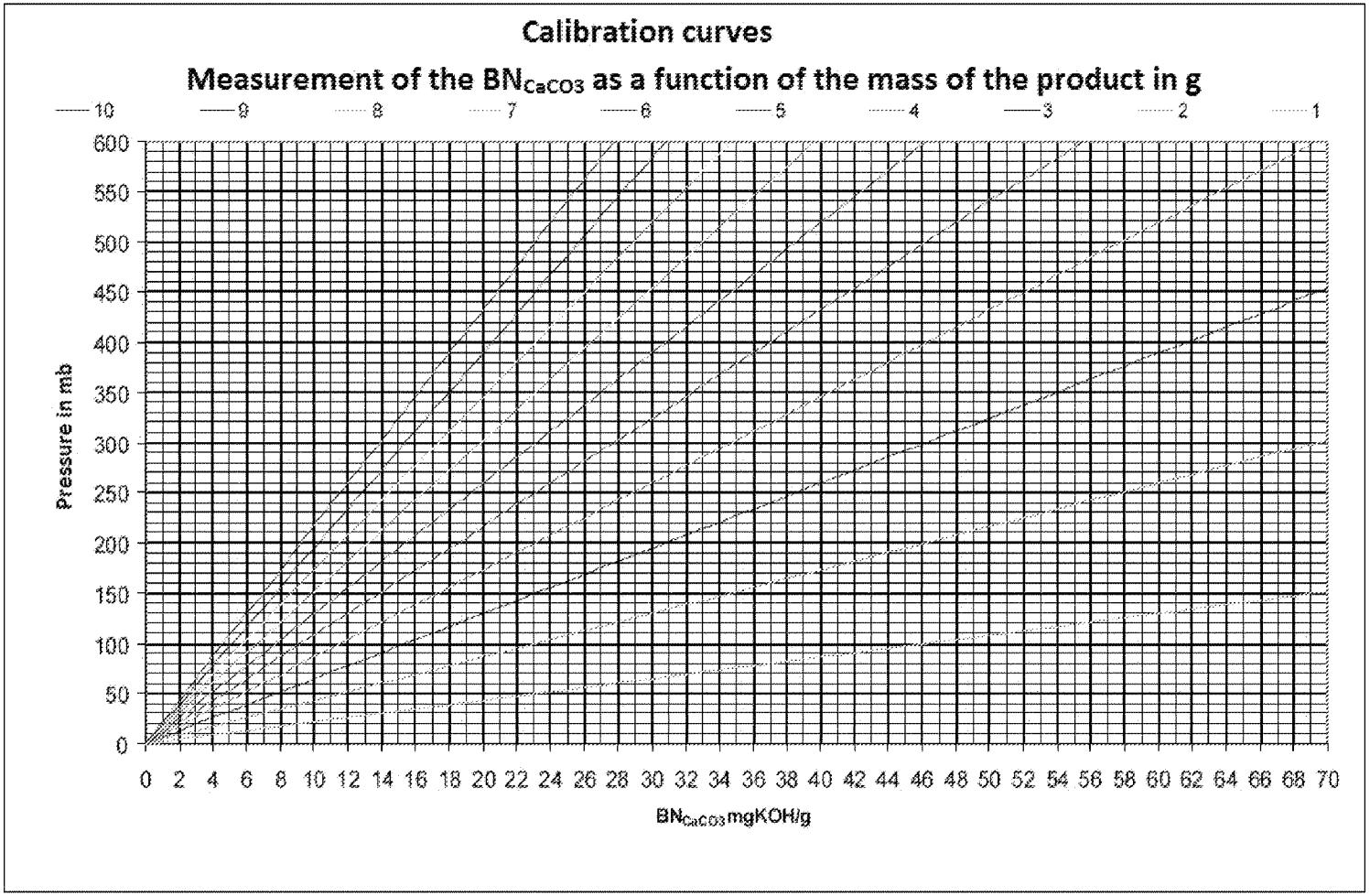
FIG. 2 is a graph illustrating calibration curves.

Procedure: in a reaction vessel with a volume of 100 ml, equipped with a stopper on which a differential manometer is fitted, the necessary quantity of product the $BN_{CaCO3}$ of which is to be measured, is weighed so as not to exceed the measurement limit of the differential manometer, which is 600 mb (mb=millibar) of pressure increase. The quantity is determined from the graph in FIG. 2, indicating for each mass of product (1 to 10 grams) the pressure measured on the differential manometer (which corresponds to the pressure increase due to the release of $CO_2$) as a function of the proportion of $BN_{CaCO3}$ in the sample. If the result of $BN_{CaCO3}$ is unknown, a moderate quantity of product of approximately 4 g is weighed. In all cases, the sample mass is noted (m).

The reaction vessel can be made of pyrex, glass, polycarbonate, etc. or any other material promoting heat exchanges with the ambient medium, such that the internal temperature of the vessel rapidly reaches equilibrium with that of the ambient medium. A small quantity of fluid base oil, of the 600 NS type, is introduced into the reaction vessel containing a small magnetic bar. Approximately 2 ml of concentrated sulphuric acid is placed in the reaction vessel, taking care not to stir the medium at this stage.

The stopper and manometer assembly is screwed onto the reaction vessel. The screw threads can be greased. Tightening is carried out to ensure a complete seal. Stirring is commenced, and continued for as long as necessary for the pressure to stabilize, and for the temperature to reach equilibrium with the ambient medium. A period of 30 minutes is sufficient. The increase in pressure P and ambient temperature T° C. (σ) are noted. The assembly is cleaned with a heptane-type solvent.

Calculation Method:

In order to calculate the pressure the ideal gas law is used.

$$PV = nRT$$

$$P = \text{Partial pressure of } CO_2(\text{Pa})(1\ \text{Pa} = 10^{-2} mb)$$

$$V = \text{Volume of the container}(m^3).$$

$$R = 8.32(J).$$

$$T = 273 + \sigma(°\ \text{C.}) = (°\ \text{K.}).$$

$$n = \text{number of moles of } CO_2 \text{ released}$$

$$P\,CO_2 = \frac{n\,CO_2 * R * T}{V} * 10^{-2}$$

Calculation of the Number of Moles of $CO_2$ $$m^* \text{carbonate BN} = \text{mg KOH equivalent.}$$

m=mass of product in grams carbonate BN=BN expressed in KOH equivalent per 1 g.

$$\frac{m * \text{carbonate } BN * \frac{44}{2 * 56.1}}{1000} = \text{g of } CO_2 \text{ released,}$$

i.e.

the number of moles of $CO_2$ released:

$$\frac{m * \text{carbonated } BN * 44 * 10^{-3}}{44 * 2 * 56.1} = m * \text{carbonated } BN * 0.0089\ 10^{-3}$$

Formula for Calculation of the Pressure of $CO_2$ as a Function of the Carbonate BN.

$$\boxed{P\,CO_2 = \frac{m * \text{carbonate } BN * 0.0089\ 10^{-3} * R * T * 10^{-2}}{V}}$$

Formula for Calculation of the Carbonate BN from the Pressure of $CO_2$.

$$\text{carbonate } BN = \frac{P * V}{m * 0.0089 * 10^{-3} * R * T * 10^{-2}}$$

By fixing the values linked to the test conditions, the simplified formula is obtained:

P $CO_2$=value read on the differential manometer, in mbars=P read

V=volume of the container in $m^3$=0.0001.

R=8.32 (J).

T=273+σ(° C.)=(° K). σ=Ambient temperature read.

m=mass of product introduced into the reaction vessel.

$$\text{carbonate } BN = \frac{P \text{ read} * 0.0001}{m * 0.0089 * 10^{-3} * 8.32 * (273 * \sigma read) * 10^{-2}}$$

$$\text{carbonate } BN = \frac{P \text{ read} * 0.0001}{m * 0.0089 * 10^{-3} * 8.32 * (273 * \sigma read) * 10^{-2}}$$

The result obtained is the $BN_{CaCO3}$ expressed in mgKOH/g.

The BN provided by the metallic soaps of detergents, also referred to as "organic BN", is obtained by the difference between the total BN according to ASTM D2896 and the $BN_{CaCO3}$ thus measured.

Enthalpy Test Measuring the Neutralization Efficiency of the Lubricants Vis-à-Vis Sulphuric Acid The enthalpy test making it possible to measure the neutralization efficiency of the lubricants vis-à-vis sulphuric acid is defined as follows. The availability or accessibility of the basic sites included in a lubricant, in particular cylinder lubricant for two-stroke marine engines, vis-à-vis acid molecules, can be quantified by a dynamic test monitoring the neutralization rate or kinetics.

Principle:

Acid-base neutralization reactions are generally exothermic and it is therefore possible to measure the release of heat obtained by reacting sulphuric acid with the lubricants to be tested. This release is monitored by the evolution of the temperature over time in an adiabatic reactor of the Dewar type. Based on these measurements, it is possible to calculate an index quantifying the efficiency of a lubricant according to the present invention compared with a lubricant used as a reference, and for an added quantity of acid representing a fixed number of BN points to be neutralized. In order to test lubricants with a BN of 70, in the examples which follow, a quantity of acid corresponding to the neutralization of 70 BN points is thus added.

The efficiency index is thus calculated relative to the reference oil to which the value of 100 is assigned. This is the ratio between the neutralization reaction times of the reference (Sref) and the measured sample ($S_{mes}$):

$$\text{Neutralization efficiency index} = S_{ref}/S_{mes} \times 100.$$

The values of these neutralization reaction times, which are of the order of a few seconds, are determined from the acquisition curves of the increase in temperature as a function of time during the neutralization reaction. (See curve in FIG. 1). The duration S is equal to the difference $t_f$–$t_i$ between the time at the temperature at the end of the reaction and the time at the temperature at the start of the reaction. The time $t_i$ at the temperature at the start of the reaction corresponds to the first rise in temperature after stirring is started. The time $t_f$ at the temperature at the end of the reaction is the time from which the temperature signal remains stable for a period of time greater than or equal to half the reaction time. The lubricant is all the more efficient as it leads to short neutralization times and therefore to a high index.

Equipment Used:

The geometries of the reactor and of the stirrer as well as the operating conditions were selected so that they are situated in the chemical regime, where the effect of the diffusional constraints in the oil phase is negligible. Therefore, in the configuration of the equipment used, the height of fluid must be equal to the internal diameter of the reactor, and the helical stirrer must be positioned at approximately ⅓ of the height of the fluid. The equipment is constituted by a 300 ml adiabatic reactor of a cylindrical type, the internal diameter of which is 52 mm and the internal height 185 mm, with a stirring rod equipped with a helix with inclined blades, 22 mm in diameter; the diameter of the blades is comprised between 0.3 and 0.5 times the diameter of the Dewar flask, i.e. 15.6 to 26 mm.

The position of the helix is fixed at a distance of approximately 15 mm from the base of the reactor. The stirring system is driven by a 10 to 5,000 rpm variable speed motor and a system for acquiring the temperature as a function of time. This system is suitable for measuring reaction times of the order of 5 to 20 seconds and for measuring the rise in temperature of a few tens of degrees starting from a temperature of approximately 20° C. to 35° C., preferably approximately 30° C. The position of the temperature acquisition system in the Dewar flask is fixed.

The stirring system will be controlled in such a way that the reaction takes place within a chemical range: in the configuration of the present experiment, the rotation speed is adjusted to 2000 rpm, and the position of the system is fixed. Moreover, the chemical range of the reaction is also dependent on the depth of the oil introduced into the Dewar flask, which must be equal to the diameter of the flask, and which corresponds in the context of this experiment to a mass of approximately 86 g of the lubricant tested.

In order to test lubricants with a BN of 70, here the quantity of acid corresponding to the neutralization of 70 BN points is introduced into the reactor. 7.01 g of sulphuric acid concentrated to 75% and 86 g of lubricant to be tested are introduced into the reactor, for a lubricant with a BN of 70. After placing the stirring system inside the reactor so that the acid and the lubricant mix well and in a reproducible manner between two tests, stirring is started in order to follow the reaction within a chemical range. The acquisition system is permanent.

Implementation of the Enthalpy Test—Calibration:

In order to calculate the efficiency indices of the lubricants according to the present invention using the method described above, we chose to take as a reference the neutralization reaction time measured for a cylinder lubricant for two-stroke marine engines $L_{ref}$ with a BN of 70 mg KOH/g of lubricant (measured by ASTM D-2896), containing no fatty amines according to the present invention. This cylinder lubricant is obtained from a mineral lubricant base oil obtained by mixing a distillate with a density at 15° C. comprised between 880 and 900 $Kg/m^3$ with a distillation residue with a density comprised between 895 and 915 $Kg/m^3$ (Brightstock) in a distillate/residue ratio of 3. A concentrate containing an overbased calcium sulphonate with a BN equal to 400 mg KOH/g, a dispersant, an overbased calcium phenate with a BN equal to 250 mg KOH/g is added to this lubricant base. This cylinder lubricant is formulated specifically to have a neutralization capacity sufficient to be used with fuels with a high sulphur content, namely sulphur contents greater than 3% or even 3.5% with respect to the total weight of the fuel oil.

This reference lubricant contains 25.50% by mass of this concentrate. Its BN of 70 mg KOH/g of lubricant is provided exclusively by the overbased detergents (overbased phenates and sulphonates) contained in said concentrate. This reference lubricant has a viscosity at 100° C. comprised between 18 and 21.5 $mm^2/s$ measured according to the standard ASTM D445. The neutralization reaction time of this oil (hereafter reference oil Href) is 75 seconds and its neutralization efficiency index is set at 100.

EXAMPLES

Example 1: Assessment of the Thermal Resistance Properties of Cylinder Lubricants According to the Invention The thermal resistance of cylinder lubricants according to the invention is assessed by implementation of the continuous ECBT test, and the engine cleanliness in the presence of such compositions is thus simulated. To this end, different cylinder lubricants were prepared from the following compounds:

- lubricant base oil 1: mineral oils of group I or Brightstock with a density comprised between 895 and 915 $Kg/m^3$,
- lubricant base oil 2: mineral oils of group I, in particular referred to as Neutral 600 NS with a viscosity at 40° C. of 120 cSt measured according to the standard ASTM D7279,
- detergent package comprising a neutral phenate with a BN equal to 150 mg KOH/g of phenate, an overbased phenate with a BN equal to 250 mg KOH/g of overbased phenate, an overbased sulphonate with a BN equal to 400 mg KOH/g of overbased sulphonate, a dispersant of the PIB succinimide type, a fatty alcohol which is a mixture of monoalcohols having a hydrocarbon-containing chain comprising from 16 to 18 carbon atoms and an anti-foaming agent,
- fatty amine 1: mixture comprising 99.9% by weight of a fatty amine of formula (I) in which $R_1$ is an alkyl group comprising from 14 to 16 carbon atoms, $R_2$ is a hydrogen atom, a fatty amine of formula (I) in which $R_1$ is an alkyl group comprising 18 carbon atoms, $R_2$ is a hydrogen atom, and a fatty amine of formula (I) in which $R_1$ is an alkyl group comprising at least 20 carbon atoms, $R_2$ is a hydrogen atom, and having a BN measured according to the standard ASTM D-2896 equal to 471 mg of potash per gram of amine (Tetrameen OV from the company AKZO NOBEL),
- fatty amine 2: mixture comprising 99.9% of a fatty triamine comprising an alkyl group comprising from 14 to 16 carbon atoms, a fatty triamine comprising an alkyl group comprising 18 carbon atoms and a fatty triamine comprising an alkyl group comprising at least 20 carbon atoms and having a BN measured according to the standard ASTM D-2896 equal to 420 mg of potash per gram of amine (Triameen OV from the company AKZO NOBEL).

The cylinder lubricants $L_1$ and $L_2$ are described in Table I; the percentages indicated correspond to percentages by mass.

TABLE I

| Compositions | $L_1$ (invention) | $L_2$ (comparative) |
|---|---|---|
| Base oil 1 | 27 | 27 |
| Base oil 2 | 49 | 49 |
| Detergent package | 20.6 | 20.6 |
| Fatty amine 1 | 3.4 | |
| Fatty amine 2 | | 3.4 |

The characteristics of the cylinder lubricants $L_1$ and $L_2$ are described in Table II.

TABLE II

| Compositions | $L_1$ (invention) | $L_2$ (comparative) |
|---|---|---|
| Total BN | 68 | 68 |
| Of which BN provided by the fatty amine (mg KOH/g, ASTM D-2896) | 16 | 14.2 |
| Of which BN provided by the metallic carbonate salts (mg KOH/g, ASTM D-2896) | 37.3 | 37.3 |

The thermal resistance of the lubricants $L_1$ and $L_2$ was therefore assessed by means of the continuous ECBT test, measuring the mass of deposits (in mg) generated under defined conditions. The lower this mass, the better the thermal resistance and therefore the better the engine cleanliness. This test simulates an engine piston brought to a high temperature onto which the lubricant from the crankcase is sprayed.

The test utilizes aluminium beakers which simulate the shape of pistons. These beakers were placed in a glass container, maintained at a controlled temperature of the order of 60° C. The lubricant was placed in these containers, themselves equipped with a wire brush, partially immersed in the lubricant. This brush was actuated with a rotary movement at a speed of 1000 rpm, which creates a spray of lubricant onto the lower surface of the beaker. The beaker was maintained at a temperature of 310° C. by an electrical heating resistance, regulated by a thermocouple.

In the continuous ECBT test, the test lasted 12 hours and the spray of lubricant was continuous throughout the duration of the test. This procedure makes it possible to simulate the formation of deposits in the piston-ring assembly. The result is the weight of deposits measured on the beaker. A detailed description of this test is given in the publication entitled "Research and Development of Marine Lubricants in ELF ANTAR France—The relevance of laboratory tests in simulating field performance" by Jean-Philippe ROMAN, MARINE PROPULSION CONFERENCE 2000—AMSTERDAM—29-30 Mar. 2000.

The results are given in Table III below. In Table III, the result obtained for the cylinder reference lubricant $L_{ref}$ described above has been added.

TABLE III

| Compositions | $L_1$ (invention) | $L_2$ (comparative) | $L_{ref}$ |
|---|---|---|---|
| Continuous ECBT (mg) | 220 | 250 | 230 |

The results show that the cylinder lubricants according to the invention have a good thermal resistance and thus make it possible to improve engine cleanliness. It is to be noted that the specific selection of a tetra-amine of formula (I) in which $R_1$ is an alkyl group comprising from 16 to 20 carbon atoms makes it possible to improve the thermal resistance with respect to a triamine also containing an alkyl group comprising from 16 to 20 carbon atoms. It is also to be noted that the cylinder lubricant according to the invention has a thermal resistance that is slightly improved with respect to the reference cylinder oil.

Example 2: Assessment of the Thermal Resistance Properties of Cylinder Lubricants According to the Invention The thermal resistance of cylinder lubricants according to the invention is assessed by implementation of the continuous ECBT test, and the engine cleanliness in the presence of such compositions is thus simulated. To this end, two cylinder lubricants $L_3$ and $L_4$ were prepared from the following compounds:

- fatty amine 3: a mixture comprising 99.9% of a fatty amine of formula (I) in which $R_1$ is an unsaturated alkyl group comprising from 18 to 20 carbon atoms, $R_2$ is a hydrogen atom, and a fatty amine of formula (I) in which $R_1$ is a saturated alkyl group comprising from 18 to 20 carbon atoms, $R_2$ is a hydrogen atom, and having a BN measured according to the standard ASTM D-2896 equal to 477 mg of potash per gram of amine (Tetrameen T from the company AKZO NOBEL),
- fatty amine 4: mixture comprising 99.9% of a fatty triamine comprising an unsaturated alkyl group comprising from 18 to 20 carbon atoms, and a fatty triamine comprising a saturated alkyl group comprising from 18 to 20 carbon atoms and a BN measured according to the standard ASTM D-2896 equal to 430 mg of potash per gram of amine (Triameen T from the company AKZO NOBEL),
- base oils 1 and 2 as well as the detergent package are identical to those described in Example 1.

The cylinder lubricants $L_3$ and $L_4$ are described in Table IV; the percentages indicated correspond to percentages by mass.

TABLE IV

| Compositions | $L_3$ (invention) | $L_4$ (comparative) |
|---|---|---|
| Base oil 1 | 28.4 | 28.4 |
| Base oil 2 | 48 | 48 |
| Detergent package | 20.6 | 20.6 |
| Fatty amine 3 | 3 | |
| Fatty amine 4 | | 3 |

The characteristics of the cylinder lubricants $L_3$ and $L_4$ are described in Table V.

TABLE V

| Compositions | $L_3$ (invention) | $L_4$ (comparative) |
|---|---|---|
| Total BN | 66 | 64.8 |
| Of which BN provided by the fatty amine | 14.3 | 12.9 |

TABLE V-continued

| Compositions | $L_3$ (invention) | $L_4$ (comparative) |
|---|---|---|
| (mg KOH/g, ASTM D-2896) | | |
| Of which BN provided by the metallic carbonate salts (mg KOH/g, ASTM D-2896) | 37.3 | 37.3 |

The thermal resistance of the lubricants $L_3$ and $L_4$ was therefore assessed by means of the continuous ECBT test, as described in Example 1. The results are given in Table VI. In Table VI the result obtained for the cylinder reference lubricant $L_{ref}$ described above has been added.

TABLE VI

| Compositions | $L_3$ (invention) | $L_4$ (comparative) | $L_{ref}$ |
|---|---|---|---|
| Continuous ECBT (mg) | 222 | 259 | 230 |

The results show that the cylinder lubricants according to the invention have a good thermal resistance and thus make it possible to improve the engine cleanliness. It is to be noted that the specific selection of a tetra-amine of formula (I) in which R1 is an alkyl group comprising from 18 to 20 carbon atoms makes it possible to improve the thermal resistance with respect to a triamine also containing an alkyl group comprising from 18 to 20 carbon atoms. As for example 2, it is to be noted that the cylinder lubricant according to the invention has a thermal resistance that is slightly improved with respect to the reference cylinder oil.

Example 3: Assessment of the Properties of Neutralization of Cylinder Lubricants According to the Invention Vis-à-Vis Sulphuric Acid The neutralization efficiency vis-à-vis sulphuric acid of cylinder lubricants according to the invention is assessed by implementation of the enthalpy test described above. To this end, the lubricants $L_1$ and $L_2$ as described in example 1 were assessed, as well as the cylinder reference lubricant $L_{ref}$ described above. The results are described in Table VII.

TABLE VII

| Compositions | $L_1$ (invention) | $L_2$ (comparative) | $L_{ref}$ |
|---|---|---|---|
| Neutralization efficiency index | 405 | 588 | 100 |

These results show that the use of a cylinder lubricant according to the invention makes it possible to obtain a very good neutralization efficiency vis-à-vis sulphuric acid, this efficiency being much greater than that obtained by the use of a reference oil. It is to be noted that the neutralization efficiency obtained by the use of a cylinder lubricant according to the invention is not far from that obtained with a cylinder lubricant comprising a triamine. Thus, examples 1, 2 and 3 demonstrate the benefit of the specific selection of a fatty amine of formula (I) with respect to other fatty polyamines, making it possible to obtain both a very good neutralization efficiency and improved thermal resistance properties, and therefore improved cleanliness of the piston-cylinder assembly.

Example 4: Assessment of the Viscosity of Cylinder Lubricants According to the Invention Vis-à-Vis Sulphuric Acid The viscosity index vis-à-vis cylinder lubricants according to the invention calculated according to the international standard ASTM D2230 is assessed. To this end, two cylinder lubricants $L_5$ and $L_6$ were prepared from the following compounds:

- fatty amine 5: ethoxylated oleic monoamine having a BN measured according to the standard ASTM D-2896 equal to 160 mg of potash per gram of amine (Ethomeen O/12 from the company AKZO NOBEL)
- base oils 1 and 2; fatty amine 1 as well as the detergent package are identical to those described in Example 1.

The cylinder lubricants $L_5$ and $L_6$ are described in Table VIII; the percentages indicated correspond to percentages by mass.

TABLE VIII

| Compositions | $L_5$ (invention) | $L_6$ (comparative) |
|---|---|---|
| Base oil 1 | 30 | 40.4 |
| Base oil 2 | 40.4 | 30 |
| Detergent package | 20.6 | 20.6 |
| Fatty amine 1 | 9 | |
| Fatty amine 5 | | 9 |

The characteristics of the cylinder lubricants $L_5$ and $L_6$ are described in Table IX.

TABLE IX

| Compositions | $L_5$ (invention) | $L_6$ (comparative) |
|---|---|---|
| Total BN | 95 | 68 |
| Of which BN provided by the fatty amine (mg KOH/g, ASTM D-2896) | 42.4 | 14.4 |
| Of which BN provided by the metallic carbonate salts (mg KOH/g, ASTM D-2896) | 37.3 | 37.3 |

The results are described in Table X; the higher the viscosity index, the better the viscosity stability as a function of the temperature.

TABLE X

| Compositions | $L_5$ (invention) | $L_6$ (comparative) |
|---|---|---|
| Neutralization efficiency index | 104 | 94 |

These results show that the incorporation of a high content of fatty amine of formula (I) in a cylinder lubricant makes it possible to maintain a satisfactory viscosity stability as a function of temperature, whereas the incorporation of the same high content of alkoxylated fatty amine in a cylinder lubricant degrades this stability.

Example 5: Assessment of the Thermal Resistance Properties of Cylinder Lubricants According to the Invention The thermal resistance of cylinder lubricants according to the invention is assessed by implementation of the continuous ECBT test, and the engine cleanliness in the presence of such compositions is thus simulated. To this end, the lubricant $L_7$ was prepared from the following compounds:

- fatty amine 6: mixture of fatty amines comprising 80% of fatty amine of formula (I) in which R1 is a hydrocarbon-containing chain comprising from 16 to 20 carbon atoms, R2 is a hydrogen atom, and 20% of a mixture of fatty monoamines and diamines, and having a BN measured according to the standard ASTM D-2896 equal to 460 mg of potash per gram of amine (Polyram S from the company CECA)
- base oils 1 and 2 and the detergent package are identical to those described in Example 1.

The cylinder lubricants $L_1$ and $L_7$ are described in Table XI; the percentages indicated corresponding to percentages by mass.

TABLE XI

| Compositions | $L_1$ (invention) | $L_7$ (comparative) |
|---|---|---|
| Base oil 1 | 27 | 27 |
| Base oil 2 | 49 | 49 |
| Detergent package | 20.6 | 20.6 |
| Fatty amine 1 | 3.4 | |
| Fatty amine 6 | | 3.4 |

The characteristics of the cylinder lubricants $L_1$ and $L_7$ are described in Table XII.

TABLE XII

| Compositions | $L_1$ (invention) | $L_7$ (comparative) |
|---|---|---|
| Total BN | 68 | 68 |
| Of which BN provided by the fatty amine (mg KOH/g, ASTM D-2896) | 16 | 15.6 |
| Of which BN provided by the metallic carbonate salts (mg KOH/g, ASTM D-2896) | 37.3 | 37.3 |

The thermal resistance of the lubricants $L_1$ and $L_7$ was therefore assessed by means of the continuous ECBT test, as described in Example 1. The results are given in Table XIII. In Table XIII the result obtained for the cylinder reference lubricant $L_{ref}$ described above has been added.

TABLE XIII

| Compositions | $L_1$ (invention) | $L_7$ (comparative) | $L_{ref}$ |
|---|---|---|---|
| Continuous ECBT (mg) | 220 | 281 | 230 |

The results show that the cylinder lubricants according to the invention have a good thermal resistance and thus make it possible to improve engine cleanliness. These results demonstrate the importance of the presence of a mixture of fatty amines having a content by weight of fatty amine of formula (I) of at least 90% and preferentially strictly less than 100% with respect to the total weight of the mixture of fatty amines in the cylinder lubricant. In fact the presence of a mixture of fatty amines comprising a content by weight of fatty amine of formula (I) of at most 80% with respect to the total weight of the mixture in a cylinder lubricant leads to a deterioration of the thermal resistance, and thus a degradation of the engine cleanliness. Thus, examples 1, 2, 3, 4 and 5 demonstrate the benefit of the specific selection of a mixture of fatty amines having a content by weight of fatty amine of formula (I) of at least 90% and preferentially strictly less than 100% with respect to the total weight of the mixture of fatty amines with respect to mixtures of fatty amines having a content by weight of fatty amine of formula (I) less than 90% with respect to the total weight of the mixture, with respect to other fatty polyamines or with respect to alkoxylated amines, making it possible to obtain both a very good neutralization efficiency and improved thermal resistance properties, while maintaining a satisfactory viscosity stability over time.

The invention claimed is:

1. A cylinder lubricant having a BN determined according to the standard ASTM D-2896 greater than or equal to 50 milligrams of potash per gram of lubricant, comprising:

at least one lubricant base oil, at least one detergent based on alkali or alkaline-earth metals, overbased with metallic carbonate salts, from 5 to 15% by weight of at least one neutral detergent, with respect to the total weight of the cylinder lubricant, and a mixture of fatty amines comprising at least one fatty amine of formula (I)

$$R_1—[NR_2(CH_2)_3]_3—NH_2 \quad (I)$$

in which:

$R_1$ represents a linear or branched, alkyl or alkenyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine, the percentage by mass of fatty amine with respect to the total weight of the lubricant being selected so that the BN provided by this compound represents a contribution ranging from 10 to 60 milligrams of potash per gram of lubricant to the total BN of the cylinder lubricant, and the percentage by mass of the overbased detergent with respect to the total weight of the lubricant being selected so that the BN provided by the metallic carbonate salts represents a contribution ranging from 30 to 70 milligrams of potash per gram of lubricant to the total BN of the cylinder lubricant.

2. The cylinder lubricant according to claim 1 in which the content by weight of fatty amine of formula (I) is strictly less than 100% with respect to the total weight of the mixture of fatty amines.

3. The cylinder lubricant according to claim 1 in which the content by weight of fatty amine of formula (I) ranges from 90 to 99.9% with respect to the total weight of the mixture of fatty amines.

4. The cylinder lubricant according to claim 1 having a BN determined according to the standard ASTM D-2896 ranging from 50 to 100 milligrams of potash per gram of lubricant.

5. The cylinder lubricant according to claim 1 in which the percentage by mass of fatty amine with respect to the total weight of the lubricant is selected so that the BN provided by this compound represents a contribution of 10 to 30 milligrams of potash per gram of lubricant.

6. The cylinder lubricant according to claim 1 in which the percentage by mass of fatty amine with respect to the total weight of the lubricant is selected so that the BN provided by this compound represents at least 10%.

7. The cylinder lubricant according to claim 1 in which the percentage by mass of the mixture of fatty amines with respect to the total weight of the cylinder lubricant ranges from 2 to 10%.

8. The cylinder lubricant according to claim 1 in which $R_1$ represents a linear or branched alkyl or alkenyl group comprising from 14 to 22 carbon atoms.

9. The cylinder lubricant according to claim 1 in which $R_2$ represents a hydrogen atom.

10. The cylinder lubricant according to claim 1 in which the mixture of fatty amines is presented in the form:

of at least one fatty amine of formula (I) in which $R_1$ represents a linear or branched, alkyl or alkenyl group comprising from 14 to 16 carbon atoms and $R_2$ represents a hydrogen atom, of at least one fatty amine of formula (I) in which $R_1$ represents a linear or branched, alkyl or alkenyl group comprising at least 18 carbon atoms and $R_2$ represents a hydrogen atom, and of at least one fatty amine of formula (I) in which $R_1$ represents a linear or branched, alkyl or alkenyl group comprising at least 20 carbon atoms and $R_2$ represents a hydrogen atom.

11. The cylinder lubricant according to claim 1 in which the mixture of fatty amines is presented in the form:

of at least one fatty amine of formula (I) in which $R_1$ represents a linear or branched alkenyl group comprising from 16 to 20 carbon atoms and $R_2$ represents a hydrogen atom, and of at least one fatty amine of formula (I) in which $R_1$ represents a linear or branched alkyl group comprising from 16 to 20 carbon atoms, and $R_2$ represents a hydrogen atom.

12. The cylinder lubricant according to claim 1 in which the overbased and neutral detergents are selected from the carboxylates, sulphonates, salicylates, naphthenates, phenates, and the mixed detergents combining at least two of these types of detergents.

13. The cylinder lubricant according to claim 1 in which the percentage by mass of the overbased detergent and of the neutral detergent, with respect to the total weight of lubricant, is selected so that the organic BN provided by the detergent soaps represents a contribution of at least 10 milligrams of potash per gram of lubricant to the total BN of the cylinder lubricant.

14. The cylinder lubricant according to claim 1 in which the percentage by mass of the overbased detergent with respect to the total weight of lubricant ranges from 8 to 30% or the neutral detergent with respect to the total weight of lubricant ranges from 5 to 10%.

15. The cylinder lubricant according to claim 1 also comprising an additional compound selected from:

the primary, secondary or tertiary fatty monoalcohols, the alkyl chain of which is linear or branched, and comprising at least 12 carbon atoms, the esters of saturated fatty monoacids comprising at least 14 carbon atoms and of alcohols comprising at most 6 carbon atoms.

16. The cylinder lubricant according to claim 1, the kinematic viscosity of which, measured according to the standard ASTM D445 at 100° C. ranges from 12.5 to 26.1 cSt.

17. A method for lubricating a cylinder in a marine engine combusting a fuel oil, the method comprising contacting the cylinder with a single lubricant comprising:

at least one lubricant base oil, at least one detergent based on alkali or alkaline-earth metals, overbased with metallic carbonate salts, from 5 to 15% by weight of at least one neutral detergent, with respect to the total weight of the cylinder lubricant, and a mixture of fatty amines comprising at least one fatty amine of formula (I)

$$R_1—[NR_2(CH_2)_3]_3—NH_2 \quad (I)$$

in which:

$R_1$ represents a linear or branched, alkyl or alkenyl group, comprising at least 14 carbon atoms, $R_2$ represents a hydrogen atom or a $—(CH_2)_2OH$ group, the content by weight of fatty amine of formula (I) being greater than or equal to 90% with respect to the total weight of the mixture of fatty amines, the fatty amine having a BN determined according to the standard ASTM D-2896 ranging from 150 to 600 milligrams of potash per gram of amine, the percentage by mass of fatty amine with respect to the total weight of the lubricant being selected so that the BN provided by this compound represents a contribution ranging from 10 to 60 milligrams of potash per gram of lubricant to the total BN of the cylinder lubricant, and the percentage by mass of the overbased detergent with respect to the total weight of the lubricant being selected so that the BN provided by the metallic carbonate salts represents a contribution ranging from 30 to 70 milligrams of potash per gram of lubricant to the total BN of the cylinder lubricant, wherein the fuel oil includes a sulphur content of less than 1% by weight with respect to the total weight of the fuel oil or a sulphur content ranging from 1 to 3.5% by weight with respect to the total weight of the fuel oil.

18. The method according to claim 17, further comprising for preventing corrosion and/or reducing the formation of insoluble metallic salt deposits in two-stroke marine engines during the combustion of any type of fuel oil the sulphur content of which is less than or equal to 3.5% by weight with respect to the total weight of the fuel oil, and the contacting the cylinder being in two-stroke marine engines.

* * * * *